US010118137B2

(12) United States Patent
Schwartz et al.

(10) Patent No.: US 10,118,137 B2
(45) Date of Patent: Nov. 6, 2018

(54) SOLID PRODUCT DISPENSER FOR SMALL VOLUME APPLICATIONS

(71) Applicant: Ecolab USA Inc., Saint Paul, MN (US)

(72) Inventors: Daniel Ronald Schwartz, Cottage Grove, MN (US); Ryan Joseph Drake, White Bear Lake, MN (US); Hope Emily Weilage, Saint Paul, MN (US); Troy Andreas Anderson, Eagan, MN (US); Sarah Elise Gilbertson, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 299 days.

(21) Appl. No.: 14/807,552

(22) Filed: Jul. 23, 2015

(65) Prior Publication Data

US 2017/0021312 A1 Jan. 26, 2017

(51) Int. Cl.
*B01F 1/00* (2006.01)

(52) U.S. Cl.
CPC ..... *B01F 1/0016* (2013.01); *B01F 1/0005* (2013.01)

(58) Field of Classification Search
CPC ..... B01F 1/0016
See application file for complete search history.

(56) References Cited

U.S. PATENT DOCUMENTS

| | | | |
|---|---|---|---|
| 4,347,224 | A | 8/1982 | Beckert et al. |
| 4,595,520 | A | 6/1986 | Heile et al. |
| 4,680,134 | A | 7/1987 | Heile |
| RE32,763 | E | 10/1988 | Fernholtz et al. |
| RE32,818 | E | 1/1989 | Fernholz et al. |
| 5,316,688 | A | 5/1994 | Gladfelter et al. |
| 5,379,813 | A | 1/1995 | Ing |
| 5,389,344 | A | 2/1995 | Copeland et al. |
| 5,580,448 | A | 12/1996 | Brandreth, III |
| 6,177,392 | B1 | 1/2001 | Lentsch et al. |

(Continued)

FOREIGN PATENT DOCUMENTS

| | | |
|---|---|---|
| EP | 0659956 A1 | 6/1995 |

OTHER PUBLICATIONS

International Patent Application No. PCT/US2016/043420, International Search Report and Written Opinion dated Nov. 3, 2016, 11 pages.

*Primary Examiner* — Donald R Spamer
(74) *Attorney, Agent, or Firm* — Fredrikson & Byron, P.A.

(57) ABSTRACT

A solid product dispenser can be used to form a dilute liquid solution from a block of solid concentrate. In cases where only a small amount of liquid solution is needed, the solid product dispenser may dissolve the block of solid concentrate quickly and substantially uniformly to provide a solution of controlled concentration. This can be contrast with larger dispensing applications where a dispenser may dissolve a block of concentrate slowly at the start and more rapidly as the dispensing progresses, producing a solution with an average concentration higher than if only a small amount of solution were produced using the dispenser. In one example, the solid product dispenser includes a fluid distribution reservoir and a solid product reservoir positioned inside of the fluid distribution reservoir and over a platform on which the solid product sits. High pressure fluid flows between the two reservoirs, turbulently contacting the solid product.

23 Claims, 9 Drawing Sheets

(56) References Cited

U.S. PATENT DOCUMENTS

| | | | | |
|---|---|---|---|---|
| 6,280,617 | B1 * | 8/2001 | Brandreth, III | C02F 1/688 137/268 |
| 8,889,048 | B2 | 11/2014 | Stolte et al. | |
| 2005/0121058 | A1 * | 6/2005 | Furber | A47L 15/4436 134/93 |
| 2006/0108455 | A1 * | 5/2006 | Thornton | A01G 25/00 239/574 |
| 2006/0191833 | A1 * | 8/2006 | Greene, III | C02F 1/688 210/206 |
| 2010/0059421 | A1 | 3/2010 | Reed et al. | |
| 2014/0263404 | A1 | 9/2014 | Snodgrass et al. | |
| 2014/0271399 | A1 | 9/2014 | Hedlund et al. | |

* cited by examiner

SOLID PRODUCT DISPENSER FOR SMALL VOLUME APPLICATIONS

TECHNICAL FIELD

This disclosure relates to solid product dispensers and, more particularly, to chemical dispensers that form liquid chemical solutions from solid product concentrates.

BACKGROUND

Aqueous chemical solutions are used in a variety of situations. For example, in different applications, aqueous cleaning solutions are used to clean, sanitize, and/or disinfect kitchens, bathrooms, schools, hospitals, factories, and other similar facilities. Aqueous cleaning solutions include one or more chemical species dissolved in water. The chemical species impart various functional properties to the water such as cleaning properties, antimicrobial activity, and the like. In different applications, an aqueous cleaning solution may be supplied by a manufacturer in a dilute, ready-to-use form or as a concentrate that is diluted onsite to form a working solution. Supplying a concentrate has the advantages of reducing shipping costs and minimizing the amount of onsite storage required to hold the chemical before use.

One way to supply concentrated chemical for onsite dilution is to provide solid chemical concentrate that is dissolved in an onsite dispenser to produce a comparatively dilute working solution. For example, a chemical can be provided as a powdered, flaked, or granular solid that is dissolved onsite in a dispenser. Another form of solid concentrate is a "cast" or block solid that is typically cast within a mold or container. The block solid can be dissolved by spraying a solvent on the block, thereby dissolving the exposed surface of the block to form a working solution. The working solution falls into a reservoir or is directed by a conduit to a cleaning apparatus. When the chemical compound is completely utilized, a fresh solid block can be inserted into the dispenser to recharge the dispenser for continued operation.

While a solid block chemical concentrate can be convenient to transport, store, and use, it can be challenging to control the concentration of the chemical in the working solution formed by applying solvent to the solid block. The rate at which the solid block erodes can change based on factors such as the temperature of the solvent, the length of time the solvent is applied to the block, the volume of solvent applied to the block, and similar factors. For example, the solid block may dissolve slowly upon being first wetted with solvent and dissolve more rapidly as solvent is continuously applied to the block. As a result, the collected solution produced during a dispense event can have a chemical concentration that is an average of the different chemical concentrations released during the dispense event. When an operator generates a comparatively large volume of working solution, the variability in the chemical concentration during the dispense event may be averaged away and negligible. However, when an operator seeks to generate a comparatively small volume of working solution, such as an amount to fill a handheld spray bottle, the variability in the chemical concentration may be more impactful.

SUMMARY

In general, this disclosure is directed to solid product dispensers and the dispensation of aqueous chemical solutions from solid chemical concentrates. In one configuration according to the disclosure, a solid product dispenser is configured to generate a dilute aqueous solution from a solid chemical concentrate by indirectly applying pressurized fluid to the solid chemical concentrate. The solid product dispenser includes a fluid supply inlet to supply pressurized fluid to the solid chemical concentrate. Instead of positioning the outlet of the fluid supply inlet to spray pressurized fluid directly against the solid chemical concentrate, the fluid supply inlet may be positioned to direct pressurized fluid in a space adjacent to and in fluid communication with the solid chemical concentrate. For example, the solid chemical concentrate can be positioned on an elevated platform having fluid openings within a dispenser housing. The pressurized fluid can be directed at a region in the housing adjacent to the elevated platform. When fluid is discharged under pressure into the housing, the fluid may travel vertically downward under a pressure greater than gravity force until the fluid is redirected generally horizontally towards the platform. The pressurized fluid can flow across and upwardly through the platform, providing turbulent flow of pressurized fluid that erodes the surface of the solid chemical concentrate positioned on the platform. The resulting working solution can discharge through an outlet located below the platform. The combination of pressurized fluid and indirect application of fluid to the solid chemical concentrate can provide a consistent erosion rate across the dispense cycle. Accordingly, while the solid product dispenser can be used in any application and to produce any desired volume of working solution, the solid product dispenser may be beneficially utilized to generate comparatively small volumes of working solution. For example, the solid product dispenser may be used to generate a volume of working solution suitable to fill a handheld spray bottle, a cleaning rag bucket, a mop bucket, or other small volume application.

A solid product dispenser according to the disclosure can have a variety of other features in addition to or in lieu of indirect application of pressurized fluid to a solid chemical concentrate. In one example, the dispenser has built-in backflow prevention to prevent working solution from backing up into the fluid supply inlet through which fresh fluid (e.g., water) is provided in the case of a flow obstruction. For example, the dispenser may include an overflow opening (e.g., air gap) positioned between the fluid supply inlet and the reaction portion of the reservoir where fluid intermixes with solid product concentrate. If working solution backs up in the working portion of the reservoir, the working solution can spill out through the overflow openings before entering the fluid supply inlet. When so configured, the solid product dispenser may be connected to a fluid source without requiring the use of a separate backflow device, such as a vacuum breaker.

As an additional example, the solid product dispenser can be configured as a modular unit, allowing multiple units of the same dispenser to be used in series. For example, solid product dispenser may have a fluid supply manifold that has inlet, outlet, and distribution lines as well as a valve. The inlet can be connected to a source of pressurized fluid, such as pressurized municipal water. Actuation of the valve can control whether pressurized fluid received through the inlet line is delivered through the outlet line (e.g., without contacting any concentrated chemical in the dispenser), through the distribution line (e.g., for application to concentrated chemical in the dispenser), or through both lines. The outlet line can be connected to one or more downstream dispensers (directly or indirectly). For example, multiple dispenser units containing the same or different concentrated chemicals can be arranged side-by-side with the inlet of one dispenser connected to the outlet of an adjacent dispenser. In this manner, a single location for connecting to a source of pressurized fluid can be used to supply multiple solid product dispenser units.

In one example, a solid product dispenser is described that includes a fluid distribution reservoir having an outlet configured to dispense a chemical solution formed in the fluid distribution reservoir, a fluid supply inlet configured to supply a pressurized fluid to the fluid distribution reservoir, and a platform located in the fluid distribution reservoir, the platform being configured to hold a solid product and expose the solid product to the pressurized fluid. The solid product dispenser also includes a solid product reservoir located in the fluid distribution reservoir, the solid product reservoir being configured to surround a portion of the solid product positioned on the platform and thereby shield the portion of the solid product from contact with the pressurized fluid. The fluid supply inlet of the solid product dispenser is positioned to dispense pressurized fluid between the fluid distribution reservoir and the solid product reservoir such that pressurized fluid is configured to flow past the solid product reservoir and contact the platform, causing the pressurized fluid to redirect against the solid product and form the chemical solution via erosion of the solid product.

In another example, a dispenser is described that includes a water distribution reservoir having a base wall and at least one sidewall extending vertically upwardly from the base wall. The water distribution reservoir also includes an outlet extending through the base wall and configured to dispense a chemical solution formed in the water distribution reservoir. The dispenser also includes a platform and a concentrated chemical reservoir. The platform is located inside of the water distribution reservoir and elevated above the base wall and outlet extending therethrough and is configured to hold a solid block of concentrated chemical and allow fluid to flow between the solid block of concentrated chemical and the outlet. The concentrated chemical reservoir is located in the water distribution reservoir and at least partially encloses the solid block of concentrated chemical in a region above the platform. The dispenser also includes a plurality of water supply inlets positioned about a perimeter of the concentrated chemical reservoir and configured to direct pressured water between the at least one sidewall of the water distribution reservoir and the concentrated chemical reservoir, causing pressured water to contact the solid block of concentrated chemical adjacent the platform and form the chemical solution via erosion of the solid block of concentrated chemical.

In another example, a method is described that includes discharging pressurized fluid between a sidewall of a fluid distribution reservoir and a sidewall of a solid product reservoir located in the fluid distribution reservoir, where the solid product reservoir contains a block of solid product positioned on a platform raised above a base wall of the fluid distribution reservoir. The method also includes directing the pressurized fluid toward the platform, thereby causing the pressurized fluid to change from a vertical flow direction with respect to gravity to a horizontal flow direction and contact the platform, providing a turbulent flow of pressurized fluid that erodes the block of solid product positioned on the platform. The method further includes discharging a chemical solution formed from erosion of the block of solid product through an outlet formed through the base wall of the fluid distribution reservoir.

The details of one or more examples are set forth in the accompanying drawings and the description below. Other features, objects, and advantages will be apparent from the description and drawings, and from the claims.

DETAILED DESCRIPTION

Figure 1:
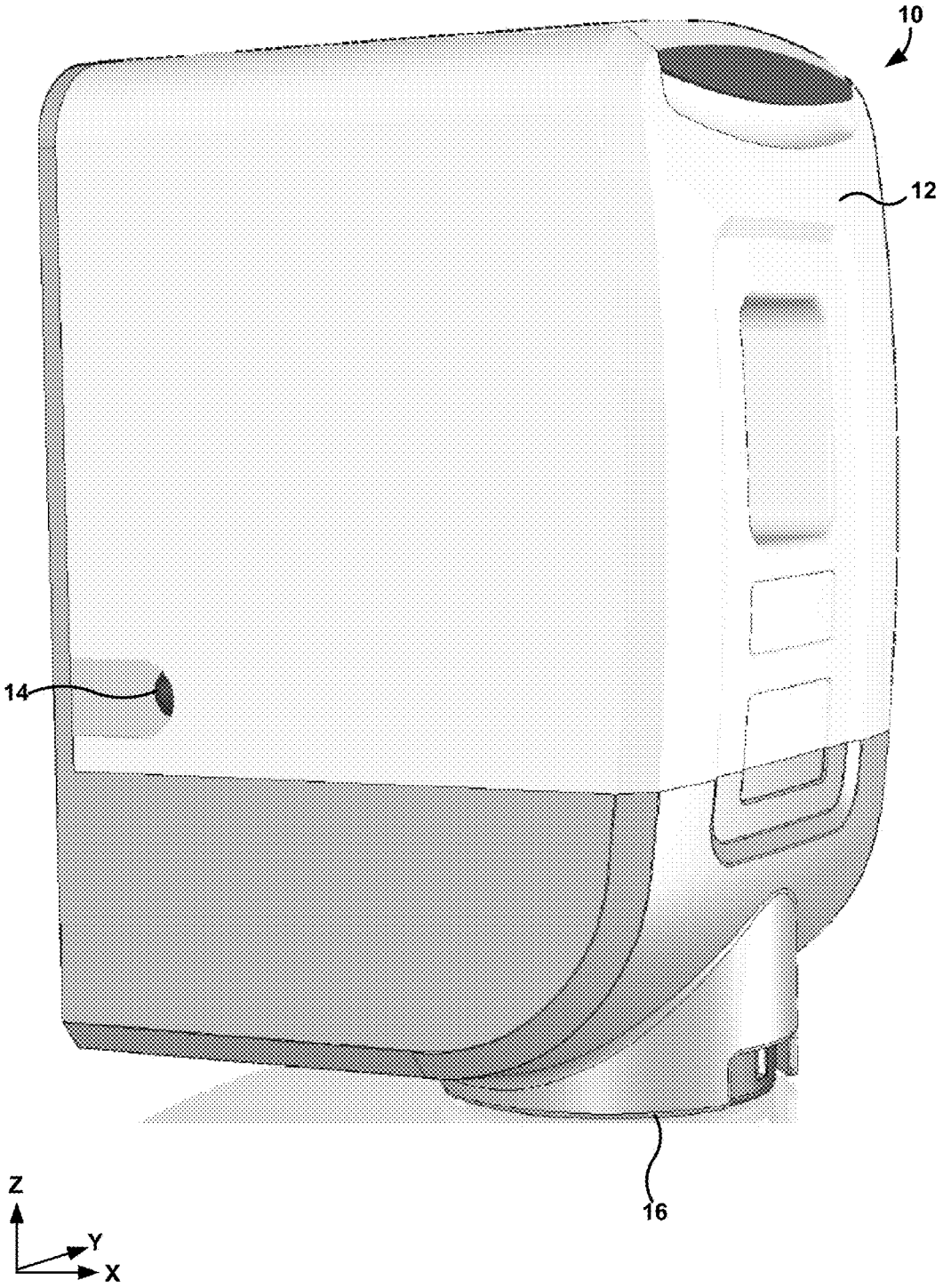
FIG. 1 is a perspective illustration of an example solid product dispenser according to the disclosure.

In general, the disclosure relates to systems, devices, and techniques for dispensing liquid products by contacting a fluid with a solid product, thereby causing the solid product to erode and enter the fluid to form the liquid product being dispensed. While the disclosed solid product dispensers can be used in any application where formation of a liquid product from a solid substrate is desired, in particular applications, the dispensers are used to form a chemical cleaning and/or sanitizing solution from a solid concentrated chemical. For example, a solid product dispensed using the dispenser may be a sanitizer, a detergent, a ware wash composition, a floor care composition, and automotive cleaning composition, or any other desired concentrated chemical. The fluid used to erode the solid product during a dispense event is typically water, although other fluids (e.g., an organic liquid) can be used in appropriate applications.

In some examples, the solid product dispenser includes a pair of reservoirs nested one inside of another. The inner reservoir is configured to receive and hold a block of solid product intended to be eroded and dispended during multiple dispense events. The outer reservoir is configured to distribute fluid and contact the fluid with solid product being dispensed. For example, a platform may be positioned on the inside bottom surface of the outer reservoir to provide an elevated surface on which the solid product is positioned. The inner reservoir can be positioned above the platform so a small gap exists between the top of the platform and the bottom of the inner reservoir, exposing the solid product within the gap.

To distribute fluid, one or more fluid supply inlets can be positioned between the inner reservoir and the outer reservoir. In operation, the fluid supply inlets can discharge pressurized fluid into the reservoir. The pressurized fluid can flow parallel to the inner reservoir in which the solid product is held until reaching the base of the outer reservoir on which the platform is positioned. Upon reaching the base of the outer reservoir, the flow of pressurized fluid may be directed generally parallel to the bottom surface of the solid product and the platform on which the solid product is positioned. The flow of fluid can contact the platform with the resulting obstructions in the flow path of the fluid creating turbulence that redirects at least a portion of the fluid flow against the bottom surface of the solid product. The turbulent flow of pressurized fluid may erode the solid product at a generally consistent and controlled rate, providing controlled release of solid product to the working solution being formed.

While the solid product dispenser can include a variety of features, in one configuration, the dispenser includes an overflow outlet, which may also be referred to as an air gap, extending through the outer reservoir. The overflow outlet may be above the platform on which the solid product resides but below the discharge point of the one or more fluid supply inlets supplying pressurized fluid to the dispenser. For example, pressurized fluid discharging from the fluid supply inlets may flow past the overflow outlet before reaching the base of the outer reservoir and the platform positioned thereon. As a result, if liquid fluid builds up inside of the outer reservoir, for example due to an obstruction of the reservoir outlet, the liquid can discharge through the overflow outlet before backing up into the fluid supply inlets. The overflow outlet feature can be achieved by positioning the fluid supply inlet above the contact area were the fluid erodes the solid product, in contrast to other dispenser configurations that directly spray the underside of the solid product. Such a feature can be useful to provide a dispenser that can be installed at a wide variety of end use locations without needing to install backflow protection devices at each specific location where the dispenser is to be installed.

FIG. 1 is perspective illustration of an example solid product dispenser 10 according to the disclosure. Dispenser 10 includes a housing 12, an inlet line 14, and a dispensing outlet 16. Housing 12 houses the various components of the dispenser, including the components that control contact between fluid received through inlet line 14 and a solid product contained within the housing. Housing 12 may include a removable cover and/or retractable lid to periodically replace exhausted solid product with fresh solid product as well as inspect or repair the internal components of the dispenser. Inlet line 14 may be a fluid conduit and/or fluid connector configured to connect dispenser 10 to a source of fluid. Dispensing outlet 16 is configured to dispense working solution generated using the dispenser into a container for transport to a subsequent distribution location or use.

In the illustrated example, dispensing outlet 16 of dispenser 10 is shown as being configured (e.g., sized and/or shaped) to connect to a handheld spray bottle. Handheld spray bottles typically have an elongated liquid reservoir with a pump actuator threadingly coupled to the top of the reservoir. With the illustrated dispenser, the pump actuator can be removed from the handheld spray bottle and the open threaded end of the bottle inserted into dispensing outlet 16. Dispenser 10 can generate working solution and dispense the working solution into the spray bottle in response to inserting the spray bottle into dispensing outlet. Dispenser 10 may continue generating and dispensing working solution until the bottle reservoir is removed from dispensing outlet 16, whereupon the dispenser stops delivering fluid to a solid product contained in housing 12.

While dispenser 10 in FIG. 1 illustrates one example configuration of dispensing outlet 16, it should be appreciated that other dispensing outlets can be used, and a dispenser according to the disclosure is not limited to the example configuration of FIG. 1. For example, other configurations, dispenser 10 may include a fluid conduit projecting out of dispensing outlet 16. The fluid conduit may be positionable in a bucket (e.g., mop bucket), reservoir of a mobile cleaning unit, or other fluid containment structure. Alternatively, dispensing outlet 16 of dispenser 10 may be piped to deliver chemical solution to one or more units which utilize such solution. For example, dispenser 10 may be piped to deliver chemical solution to a ware wash machine, laundry machine, automotive wash, or any other desired application.

Dispenser 10 can be activated a number of different ways to generate and dispense cleaning solution. In some examples, dispenser 10 includes a user interface (e.g., push button) that a user engages to activate the dispenser. In other examples, dispenser 10 includes a sensor (e.g., non-contact/touchless sensor or contact sensor) which, upon sensing activation of a dispense event, causes the dispenser to generate and dispense solution. For example, dispenser 10 may include a sensor which senses the presence of a spray bottle reservoir, when placed in dispensing outlet 16, and responds by generating and dispensing solution through the dispensing outlet. In still other examples, dispenser 10 may periodically and/or automatically activate to generate solution, for example, in response to an out-of-product signal received reservoir to which the dispenser dispenses.

Figure 2:
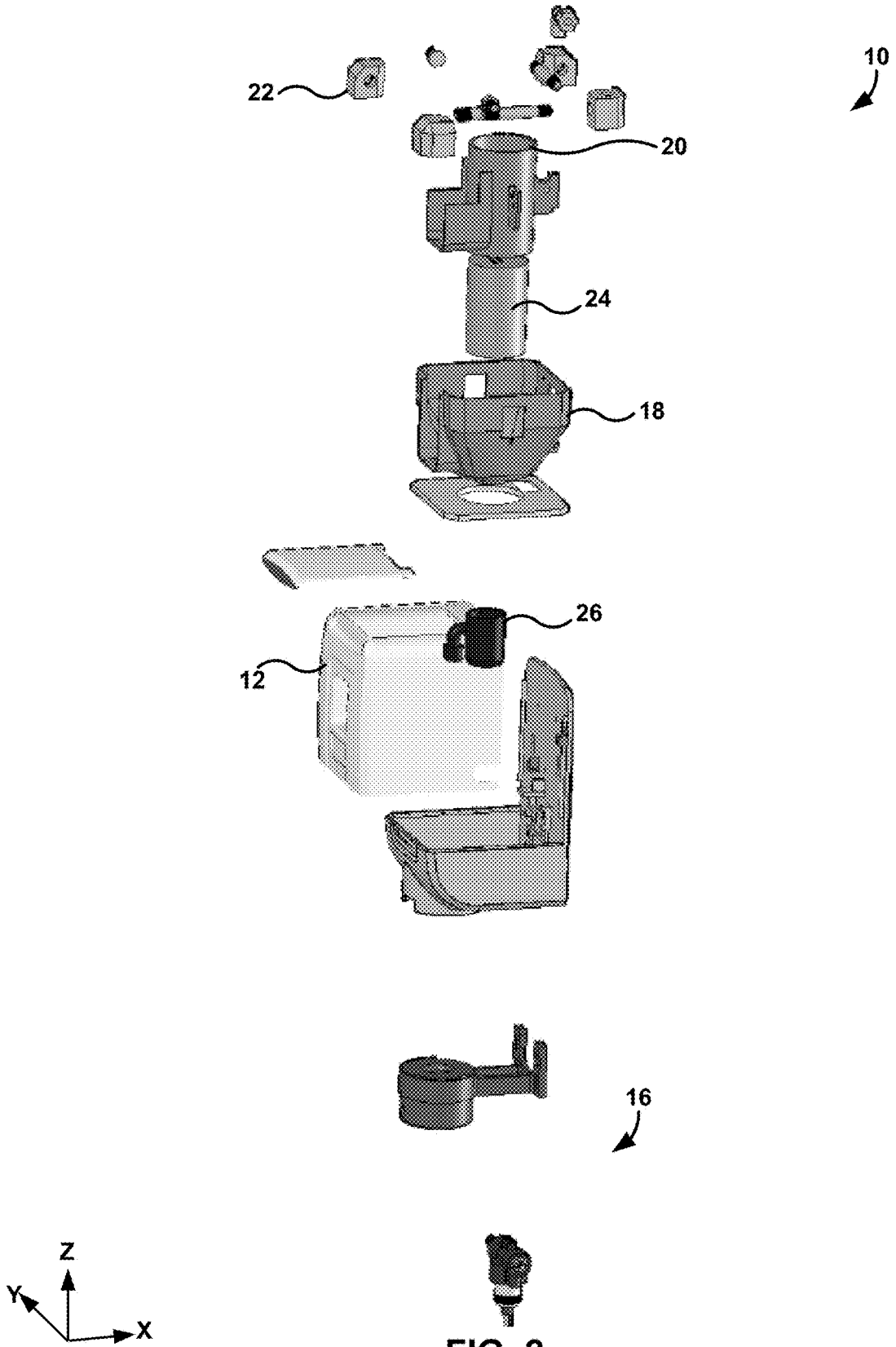
FIG. 2 is an exploded perspective view of the example solid product dispenser of FIG. 1.

FIG. 2 is an exploded perspective view showing an example arrangement of components that can be housed within dispenser 10. In the illustrated example, dispenser 10 includes a fluid distribution reservoir 18 (also referred to herein as "water distribution reservoir 18" or "distribution reservoir 18"), a solid product reservoir 20 (also referred to herein as "concentrated chemical reservoir 20" or "product reservoir 20"), and at least one fluid supply inlet 22. Product reservoir 20 is located inside of fluid distribution reservoir 18 and configured to receive and hold a solid product 24 to be dispensed. For example, solid product 24 may be a single, unitary block of concentrated chemical which is configured to erode upon application of fluid to the surface of the product. The at least one fluid supply inlet 22, which is illustrated as being a plurality of fluid supply inlets, may be in selective fluid communication with inlet line 14 (FIG. 1) and configured to supply fluid to fluid distribution reservoir 18.

In operation, dispenser 10 can generate a liquid solution by contacting fluid with solid product 24 inside of fluid distribution reservoir 18. Pressurized fluid can be delivered through fluid supply inlet 22 to fluid distribution reservoir 18. The pressurized fluid can flow past product reservoir 20 until reaching the base of fluid distribution reservoir 18 upon which solid product 24 is supported. For example, solid product 24 may be positioned on a platform elevated above the bottom surface of fluid distribution reservoir 18 and may project beyond the lowermost extend of product reservoir 20. Pressurized fluid distributed through fluid supply inlet 22 can interact with solid product 24 by flowing adjacent to and in contact with the portion of the product resided on the platform elevated above the base of fluid distribution reservoir. As the pressurized fluid contacts solid product 24, the fluid can wear away the outer surface of the solid product, causing the worn away portion of the solid product to enter the fluid and thereby form a working solution containing the solid product.

The working solution generated inside of fluid distribution reservoir 18 of dispenser 10 can be discharged through an outlet in the base of the reservoir. In the illustrated example of FIG. 2, a drip catch 26 is positioned downstream of the outlet such that solution produced using dispenser 10 flows through the drip catch before being dispensed through dispensing outlet 16. Drip catch 26 can prevent drips that may otherwise occur at the end of a dispense event from dropping out through dispensing outlet 16, instead catching the drips to be conveyed out during a subsequent dispense event.

Figure 3A:
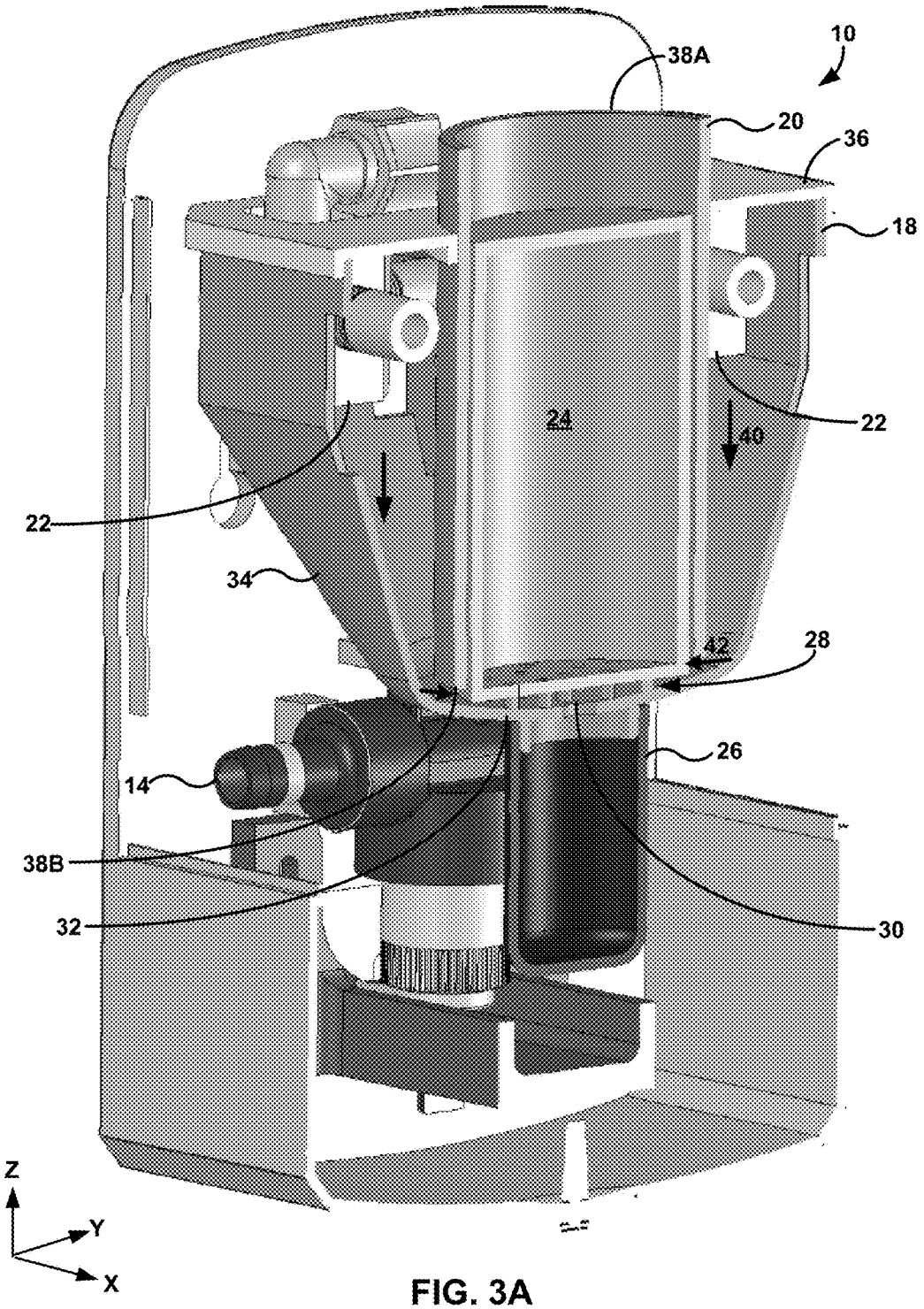
FIGS. 3A and 3B are different sectional views of the example solid product dispenser of FIG. 1 showing different example features of the dispenser.
Figure 3B:
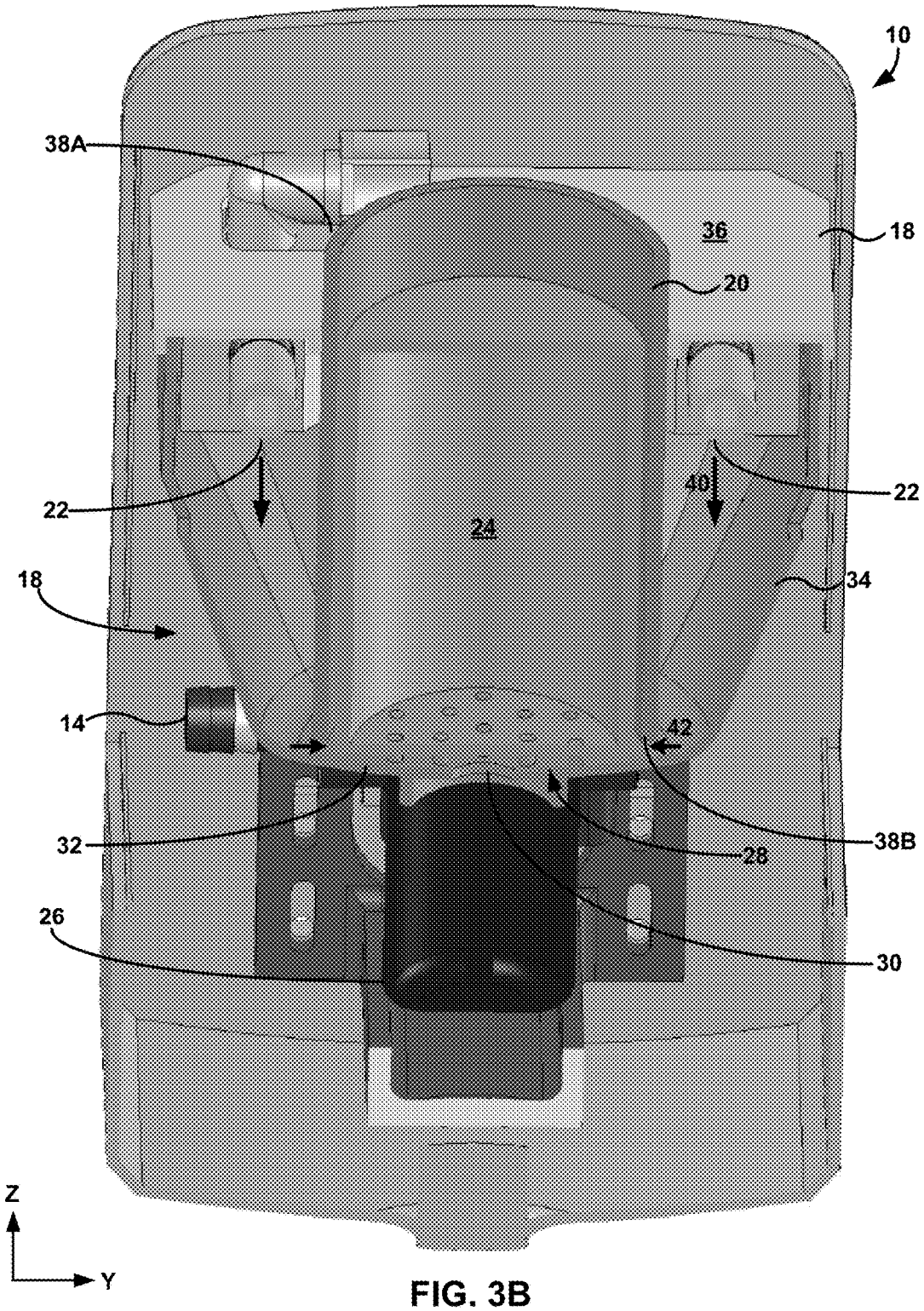

FIGS. 3A and 3B (referred to collectively as "FIG. 3") are different sectional views of dispenser 10 showing an example configuration of components in the dispenser. As shown in FIG. 3, dispenser 10 includes previously-mentioned fluid distribution reservoir 18, product reservoir 20, fluid supply inlet 22, and solid product 24. Solid product 24 is illustrated in FIG. 3 as being hollow for purposes of visualization, although in practice solid product 24 would typically be a continuous, integral mass of material, such as molded, cast, pressed, or extruded block of material. In the illustrated example, dispenser 10 also includes a platform 28 on which solid product 24 is positioned and an outlet 30 formed in fluid distribution reservoir 18. Platform 28 elevates solid product 24 above a base wall 32 that forms a bottom surface of fluid distribution reservoir 18. Outlet 30 is configured to dispense a chemical solution formed in distribution reservoir 18 by erosion of solid product 24.

Product reservoir 20 in the illustrated configuration is positioned inside of fluid distribution reservoir 18. In some examples, such as that illustrated in FIG. 3, product reservoir is positioned inside of fluid distribution reservoir 18 such that the perimeter of the fluid distribution reservoir surrounds the perimeter of the product reservoir (e.g., in the X-Y plane indicated on FIG. 3). For example, product reservoir 20 can be positioned inside of fluid distribution reservoir 18 such that a separation gap exists between the product reservoir and the fluid distribution reservoir. The separation gap may define a cavity through which fluid can flow and chemical solution can be generated during operation of dispenser 10. The distance between product reservoir 20 and fluid distribution reservoir 18 can vary, e.g., based on the desired throughput of the dispenser.

In addition, although product reservoir 20 in FIG. 3 is surrounded about its entire perimeter by fluid distribution reservoir 18, in other configurations, only a portion of product reservoir 20 may be positioned inside of fluid distribution reservoir 18. For example, product reservoir 20 and fluid distribution reservoir 18 may share a common wall surface with the remaining portion of the product distribution reservoir projecting away from the shared wall into the interior of distribution reservoir 18. In general, product reservoir 20 may be positioned inside of fluid distribution reservoir 18 to the extent needed to expose solid product 24 inside of product reservoir 20 to fluid conveyed through distribution reservoir 18.

Fluid distribution reservoir 18 may be any receptacle or chamber for holding fluid during generation of a working fluid inside of dispenser 10. In the example of FIG. 3, distribution reservoir 18 comprises a basin that extends outwardly (e.g., in the X and Y directions) and vertically upwardly (e.g., in the Z-direction) from the outlet 30. Fluid distribution reservoir 18 includes base wall 32 and at least one sidewall 34 which, collectively, bound and define the reservoir.

Base wall 32 may be a generally horizontal surface that forms a lowermost surface of distribution reservoir 18. In some examples, base wall 32 slopes towards outlet 30 to facilitate drainage of working solution through the outlet. The at least one sidewall 34 can extend vertically away from the base wall, thereby increasing the height and volume of the reservoir. The at least one sidewall 34 is illustrated as being implemented with four sidewalls to form a generally rectangular cross-sectional shape. While distribution reservoir 18 is illustrated as defining a substantially rectangular shape, in other examples the reservoir can define other shapes. For example, distribution reservoir 18 can define any polygonal (e.g., square, hexagonal) or arcuate (e.g., circular, elliptical) shape, or even combinations of polygonal and arcuate shapes.

Product reservoir 20 is configured to receive solid product 24 and position the product inside of fluid distribution reservoir 18. Product reservoir 20 may be a receptacle or chamber (e.g., an annulus) that at least partially, and in some examples fully, surrounds and/or encloses solid product 24 around its perimeter over at least a portion of the length of the solid product. For example, product reservoir 20 may provide a wall surface positioned between fluid discharged from fluid supply inlet 22 and solid product 24, shielding the portion of the product positioned behind the wall surface from contact with the fluid. This can help prevent premature erosion of solid product 24 over regions not intended to be contacting with flowing fluid, providing more consistent erosion and concentration control.

Dispenser 10 in FIG. 3 includes a top wall 36 positioned above fluid supply inlet 22 and bounding fluid distribution reservoir 18. Product reservoir 20 extends vertically downwardly from, and in the illustrated example through, top wall 36. In particular, product reservoir 20 extends from a first terminal end 38A to a second terminal end 38B, with the first terminal end 38A being vertically elevated relative to the second terminal end 38B. Product reservoir 20 has an open top end defined by first terminal end 38A through which solid product 24 is inserted. Product reservoir 20 also has an open bottom end defined by second terminal end 38B, allowing solid product 24 to fall through the bottom of the product reservoir (e.g., under the force of gravity) and rest on platform 28. In other examples, the top end and/or bottom end of product reservoir 20 may be partially or fully sealed.

Typically, product reservoir 20 has a size and shape that matches and is complementary to the size and shape of the solid product 24 intended to be inserted into the reservoir. For example, where solid product 24 is configured with a cylindrical shape, product reservoir 20 may also be cylindrically shaped and have an inner diameter larger than the outer diameter of the solid product. In general, product reservoir 20 can define any polygonal (e.g., square, hexagonal) or arcuate (e.g., circular, elliptical) shape, or even combinations of polygonal and arcuate shapes. In some examples, the size and shape of solid product 24 and product reservoir 20 are coordinated to provide a matching lock and key arrangement, preventing a user from inserting a solid product not intended for use in dispenser 10 into the dispenser.

Dispenser 10 also includes platform 28 positioned inside of fluid distribution reservoir 18. Platform 28 can have a variety of different configurations, as discussed in greater detail with respect to FIG. 4. In general though, platform 28 can provide a surface raised above base wall 32 of distribution reservoir 18 on which solid product 24 rests. For example, platform 28 may be one or more structures projecting vertically upwardly away from base wall 32, thereby allowing fluid to flow between a vertical lowermost surface of solid product 24 and base wall 32. In different examples, platform 28 may be integrally (e.g., permanently) formed with fluid distribution reservoir 18 or product reservoir 20, or may be a physically separate structure located inside of distribution reservoir 18.

Independent of whether platform 28 is formed with or separate from one or more of the reservoirs comprising dispenser 10, the platform may positioned relative to product reservoir 20 to receive and support solid product 24. For example, platform 28 may be positioned between a lowermost end of product reservoir 20 defined by second terminal end 38B and base wall 32 of distribution reservoir 18. When so configured, solid product 24 inserted into product reservoir 24 can travel along the length of the product reservoir until the lowermost end of the solid product exits the open bottom end of the product reservoir and lands on an upper surface of platform 28. In some examples, such as the example shown in FIG. 3, a geometric center of product reservoir 20 is co-axial with a geometric center of platform 28 (e.g., via an axis extending vertically with respect to gravity), thereby aligning the bottom opening of the product reservoir with the top surface of the platform.

When configured as shown in FIG. 3, fluid supply inlet 22 is positioned at a vertically elevated location above platform 28 and in a cavity formed between fluid distribution reservoir 18 and product reservoir 20. Fluid supply inlet 22 is configured to deliver pressurized fluid from a fluid supply and discharge the fluid into distribution reservoir 18. In other examples, fluid supply inlet 22 can extend through sidewall 34 of distribution reservoir 18 or have a different positioning in dispenser 10 than illustrated.

In operation, fluid supply inlet 22 discharges pressurized fluid into fluid distribution reservoir 18. The pressurized fluid can flow vertically downwardly between fluid distribution reservoir 18 and product reservoir 20 as indicated by arrows 40 in FIG. 3. As the pressurized fluid contacts sidewall 34 and/or base wall 32 of distribution reservoir 18, the fluid may change flow direction from a general downward vertical direction indicated by arrows 40 to a generally horizontal direction indicated by arrows 42. For example, upon changing direction, the pressurized fluid may flow toward outlet 30 of distribution reservoir 18.

As the pressurized fluid flows along base wall 32 and/or sidewall 34, the fluid can flow around and through platform 28. For example, platform 28 may function to both support solid product 24 and provide obstructions to the flow path of the fluid. As a result, as the flowing fluid contacts platform 28, at least a portion of the fluid may be redirected upwardly against the bottom surface of solid product 24. Additionally, platform 28 may create discontinuities in the flow of the fluid, helping to create or maintain a turbulent fluid flow regime in the region of platform 28 and solid product 24. For example, the fluid flowing between and/or around platform 28 and solid product 24 may be characterized by chaotic velocity changes that vary erratically in magnitude and direction (and may exhibit a Reynolds number greater than 2100). The turbulent flow can help to erode solid product 24 more rapidly than if the fluid flows under laminar conditions, which may help initiate quick erosion of the solid product during small volume dispense events.

As pressurized fluid erodes solid product 24, the eroded solid product can intermix with the fluid to form a chemical solution intended to be dispensed from dispenser 10. The chemical solution is discharged through outlet 30 formed in base wall 32 of distribution reservoir 18. Typically, outlet 30 is positioned proximate platform 28 and solid product 24 such that pressurized fluid introduced via fluid supply inlet 22 flows simultaneously towards the outlet and the solid product. For example, in the configuration of FIG. 3, outlet 30 is positioned vertically below the bottom surface of solid product 24 and platform 28 on which the solid product resides. In some examples, a geometric center of outlet 30 is co-axial with a geometric center of platform 28 and/or product reservoir 20, thereby aligning the features in a vertically stacked arrangement.

The configuration of outlet 30 can vary, for example depending on the flow characteristics of the dispenser and intended throughput of the dispenser. For example, the size and shape of outlet 30 (or multiple outlets, when used) can vary depending on the amount of fluid backup desired and, corresponding, the amount of solid product 24 wetted by fluid backup. If outlet 30 is sized large relative to the volume of pressurized fluid dispensed from fluid supply inlet 22, the fluid may pass through distribution reservoir 18 without accumulating in the reservoir. By contrast, if outlet 30 is sized smaller relative to the volume of pressurized fluid dispensed from fluid supply inlet 22, fluid may accumulate in fluid distribution reservoir 18 during the course of a dispense event. As fluid accumulates, the liquid level in distribution reservoir 18 may rise, wetting solid product 24 along the sides of the product (e.g., up into product reservoir 20), increasing the surface area of the solid product subject to erosion. Therefore, while dispenser 10 is generally described as providing pressurized fluid that flows between distribution reservoir 18 and product reservoir 24 and that contacts and is redirected by platform 28 not all pressurized fluid dispensed may exhibit such flow behavior. Rather, such flow behavior may be exhibited upon activation of dispenser 10 with subsequent incoming fluid flowing into a pool of fluid accumulated inside of fluid distribution reservoir 18.

In different examples, outlet 30 of fluid distribution reservoir 18 may have a fixed open area or an adjustable open area. Configuring outlet 30 to be adjustable (e.g., having a diameter that can be varied larger and smaller) may be useful to control the amount of fluid backup inside of distribution reservoir 18. In turn, because fluid backup impacts the amount of surface area of solid product 24 wetted, this can adjust the concentration of solid product in the chemical solution dispensed from dispenser 10.

As mentioned above, solid product 24 can be any suitable composition intended to be dispensed via dispenser 10. As examples, solid product 24 may be a detergent, a sanitizer, a floor care product, a ware wash product, an automotive product, a pest control product (pesticide), a hard surface cleaner, a water treatment additive (e.g., for cooling towers, waste water treatment, boiler feed water, swimming pools, and/or drinking water) or any other desired chemical composition or combination of chemical compositions. In some examples, solid product 24 is a single, physically integral solid that is positionable inside of product reservoir 20. For example, solid product 24 may be formed by casing, molding, extrusion, or pressing. Solid product 24 may be one or more blocks of solid chemical, a powder, a flake, a granular solid, or other suitable form of solid. Examples of solid product suitable for use in dispenser 10 are described, for example, in U.S. Pat. No. 4,595,520, U.S. Pat. No. 4,680,134, U.S. Reissue Pat. Nos. 32,763 and 32,818, U.S. Pat. No. 5,316,688, U.S. Pat. No. 6,177,392, and U.S. Pat. No. 8,889,048. The surface of solid product 24 can erode by degrading and shearing off from the remainder of the product in response to being wetted with fluid. In different examples, solid product may or may not react with fluid to form a resulting chemical solution dispensed from dispenser 10. The composition of solid product 24 may be controlled so the product degrades over multiple sequential dispense events, thereby necessitating only periodic replacement of the solid product with replacement unit of the product.

In general, solid product 24 can have any polygonal (e.g., square, hexagonal) or arcuate (e.g., circular, elliptical) shape, or even combinations of polygonal and arcuate shapes. Further, as mentioned above, the size and shape of solid product 24 and product reservoir 20 may be coordinated to provide a matching lock and key arrangement to prevent insertion of the wrong solid product into the wrong dispenser. For example, a detergent may be formed in a pentagonal shape, a sanitizer formed in a hexagonal shape, and a floor care product formed in a square shape. The dispensers used for each solid product can have a corresponding shape indexed product reservoir 20.

Any desired type of fluid can be introduced into dispenser 10 to form a chemical solution from erosion of solid product 24. Generally, the fluid is a liquid, such as a solvent selected to erode solid product 24. Typically, water or an aqueous-based fluid will be used as the fluid that is dispensed through fluid supply inlet 22, although non-aqueous (e.g., organic) fluids can be used in appropriate applications. When water is used as the fluid, the water may be supplied directly from a source without treatment (e.g., pressurized municipal water main, well) or may be first treated (e.g., via filtration, ion exchange).

The pressure of the fluid dispensed from fluid supply inlet 22 and/or contacting solid product 24 impacts the rate of erosion of the solid product and, correspondingly, the concentration of the solid product in the resulting chemical solution. Typically, the fluid is pressurized an amount sufficient to impact solid product 24 with a force greater than what would be generated if the solvent was accelerated only under the force of gravity inside of fluid distribution reservoir 18. For example, the fluid in these applications may be pressurized to a pressure above what can be generated by gravity inside of dispenser 10. While the pressure of the pressurized fluid dispensed from fluid supply inlet 22 and/or contacting solid product 24 can vary, in some applications, the pressure ranges from 5 pounds per square inch (psig) to 100 psig, such as 10 psig to 80 psig, from 20 psig to 70 psig, or from 50 psig to 75 psig. In other configurations, dispenser 10 may be operated by discharging unpressurized fluid from fluid supply inlet 22 and allowing pressure to build as the fluid accelerates under the force of gravity inside of distribution reservoir 18. Additional fluid control features are described in greater detail with respect to FIG. 6.

The volume of fluid dispensed from fluid supply inlet 22 during a dispense event (or the combination of the inlets when multiple are used) can vary based on factors such as the amount of chemical solution desired to be dispensed and the desired concentration of the chemical solution. In some examples, fluid supply inlet 22 (or the combination of the inlets when multiple are used) are configured to dispense less than 20 gallons during a single dispense event, such as less than 10 gallons, less than 5 gallons, less than 1 gallon, or less than ½ gallon. For example, dispenser 10 may discharge from approximately ⅛ gallon to approximately 1 gallon of fluid inside of fluid distribution reservoir 18 during a dispense event. A dispense event may be measured from activation of dispenser 10 to deactivation of the dispenser and may produce an amount of chemical solution sufficient to fill a container fluidly coupled to the dispenser, such as a handheld spray bottle.

Figure 4:
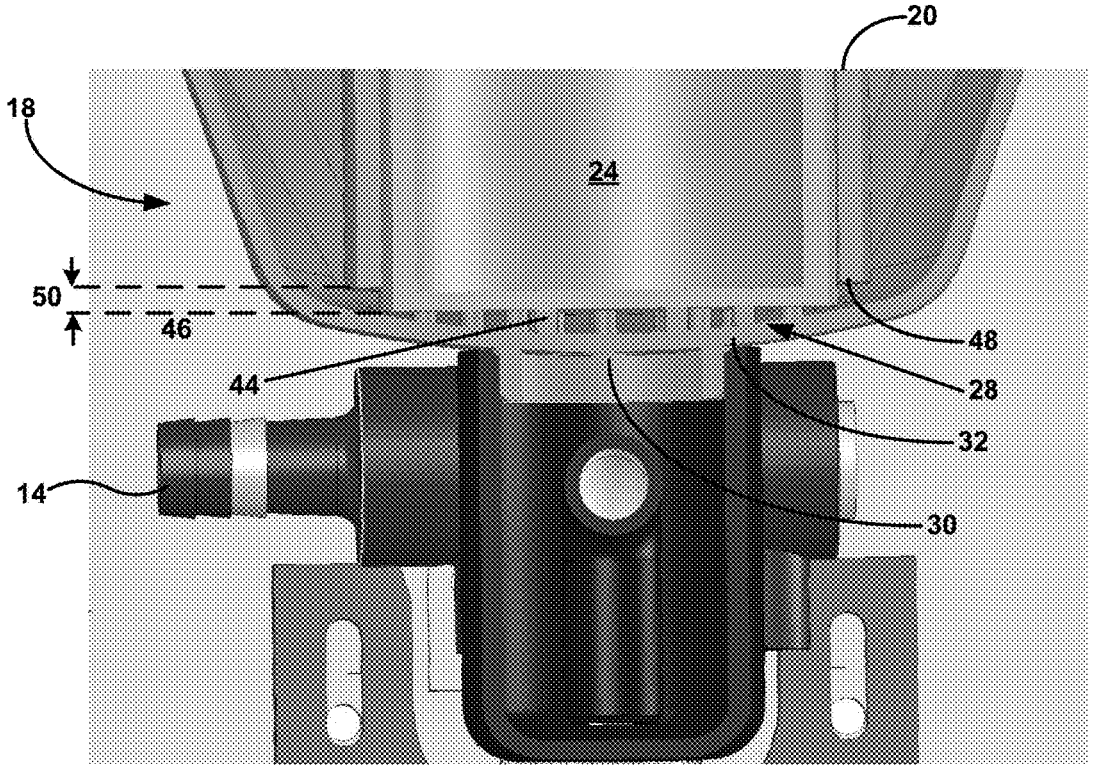
FIG. 4 is a focused sectional view on a set of features illustrated in FIGS. 3A and 3B.
Figure 4:
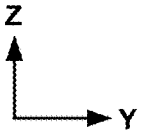

As briefly noted above, platform 28 can have a variety of different features and configurations. FIG. 4 is a focused sectional view on platform 28 illustrated in FIG. 3 showing an example arrangement of features. As shown, platform 28 is formed of a plurality of pegs 44 extending vertically upwardly from base wall 32 of fluid distribution reservoir 18. Each peg 44 may be an elongated member having a cross-sectional area (e.g., in the Z-Y plane indicated on FIG. 4) less than the cross-sectional area of solid product 24 with which the peg contacts. Pegs 44 can have any suitable size, shape, and length. As examples, each peg 44 may have a height ranging from 0.05 inches to 0.5 inches (e.g., 0.025 inches) and a cross-sectional area ranging from 0.005 square inches to 0.1 square inches (e.g., 0.012 square inches). For instance, when each peg 44 is a cylinder, the cylinder may have a diameter ranging from 0.05 inches to 0.25 inches (e.g., 0.13 inches). The distance between adjacent pegs may range from 0.01 inches to 0.5 inches. For example, depending on the size and number of pegs, the percentage of the bottom surface area of solid product 24 in contact with pegs 44 may range from 0.05% to 25%, such as from 0.1% to 5%.

In some examples, each of pegs 44 extends to the same vertical position inside of distribution reservoir 18 to collectively provide a flat surface on which solid product 24 rests. Each peg 44 may be spaced from each other peg a distance sufficient to allow fluid to flow between adjacent pegs. Accordingly, when fluid is discharged from fluid supply inlet 22, the fluid can flow in the spaces between adjacent pegs and up against solid product 24.

While pegs 44 provide one example way of implementing platform 28, other types of structures that can support solid product 24 and allow fluid flow thereunder can be used without departing from the scope of the disclosure. For example, platform 28 may be implemented using a grate and/or rows of bars extending upwardly inside of dispenser 10.

Independent of the specific structure used to elevate solid product 24 and define platform 28, the structure may form flow obstructions that help create and/or maintain turbulent fluid flow that contacts solid product 24. For example, as pressurized fluid flows toward outlet 30, fluid may impinge against the structure raised above base wall 32 and supporting solid product 24. This can create discontinuities in the path of the fluid flow, turbulizing the flow. In addition, the discontinuities in the path of the fluid flow can cause the fluid to redirect and bounce off the support structure. At least a portion of this flow may be redirected from a lateral flow pathway directed towards outlet 30 to a longitudinal flow pathway directed to solid product 24 on platform 28.

The amount of solid product 24 eroded during operation of dispenser 10 can be controlled, in part, by controlling the positioning of solid product reservoir 20 relative to platform 28. In FIG. 4, platform 28 forms a top surface 46 contacting a bottom surface of solid product 24. Further, the top surface 46 of platform 28 is vertically spaced from a bottom edge 48 of product reservoir 20 a distance 50. As a result, solid product 24 protrudes downwardly below solid product reservoir distance 50 and may be exposed to flowing fluid during operation of the dispenser. In some examples, distance 50 may range from 0.1 inches to 5 inches, such as 0.5 inches to 2 inches, although other separation distances can be used and the disclosure is not limited in this respect.

When platform 28 is implemented using pegs 44, the pegs can support solid product 24 above base floor 32 as fluid flows through the spaces therebetween. Pegs 44 may be sized to be shorter than the depth of the fluid so that the fluid will contact at least a portion of solid product 24 as it flows through pegs 44. Taller pegs 44 can support solid product 24 further above base wall 32 of the dispenser than shorter pegs, thereby supporting solid product 24 further out of the fluid and changing the amount of surface contact therebetween. Peg heights may be optimized in a laboratory or factory prior to implementation into dispenser 10 so that a desired amount of interaction between solid product 24 and the fluid may occur depending on specific fluid flow conditions or a range thereof. In some examples, adjustable or interchangeable pegs may be used, allowing the end user to change the height of pegs 44. In addition, pegs 44 may be affixed to a peg plate, which may itself be entirely replaceable by the user. The number or area density of pegs may vary from embodiment to embodiment. It will be appreciated, however, that a lower number of pegs may result in more exposed surface area of solid product 24 and, correspondingly, more mass of the solid product per surface area of pegs. If solid product 24 is not adequately supported by pegs 44, the solid product 24 may sink down onto the pegs and become embedded therein. Conversely, if too many pegs are used, the density of the pegs may inhibit the flow of fluid between adjacent pegs.

Figure 5:
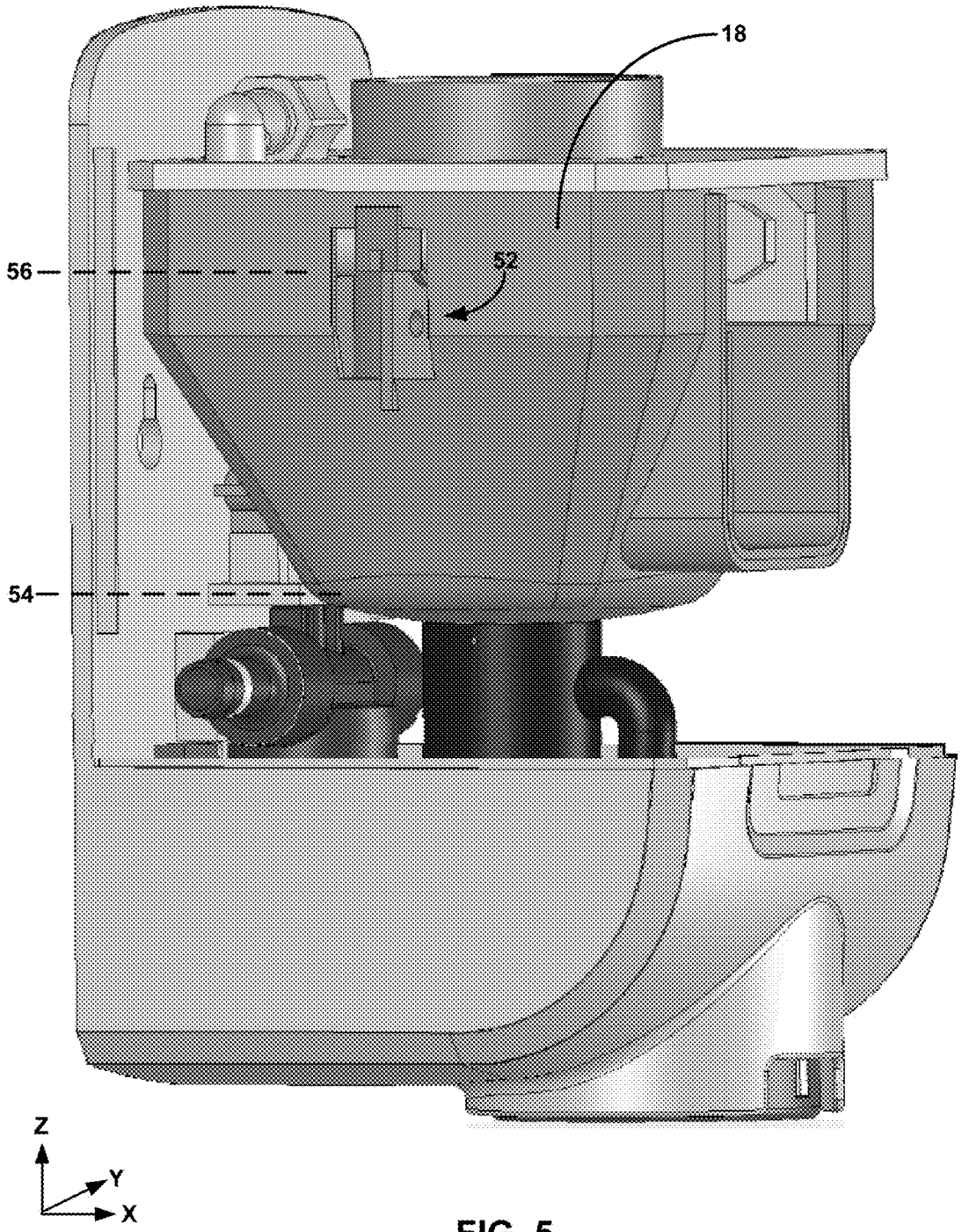
FIG. 5 is a side view illustration of the solid product dispenser of FIG. 1 showing an example overflow outlet.

In addition to or in lieu of the features discussed above, dispenser 10 can have a variety of other design features to support safe and efficient operation of the dispenser. For instance, in one example, dispenser 10 includes an overflow outlet formed in fluid distribution reservoir 18 that is configured to prevent fluid backup in the case of an occluded outlet 30. FIG. 5 is a side view illustration of dispenser 10 from FIG. 1 showing an example overflow outlet 52. Dispenser 10 is illustrated in FIG. 5 without housing 12 for purposes of illustration.

As shown in FIG. 5, overflow outlet 52 is positioned above platform 28 (indicated by position 54) and below fluid supply inlet 22 (indicated by position 56). For example, a lowermost extent of overflow outlet 52 may be vertically elevated with respect to an uppermost extent of platform 28 and an uppermost extent of overflow outlet 52 lower than a lowermost extent of fluid supply inlet 22. In operation, pressurized fluid discharging from fluid supply inlet 22 may flow past overflow outlet 52 before reaching base wall 32 (FIG. 3) of fluid distribution reservoir 18 and platform 28 positioned thereon. If liquid fluid builds up inside of distribution reservoir 18, for example due to an obstruction of outlet 30, the liquid can discharge through overflow outlet 52 before backing up into fluid supply inlet 22.

By elevating fluid supply inlet 22 with respect to platform 28 as shown in the illustrated configuration of dispenser 10, overflow outlet 52 can be built directly into the dispenser as illustrated in FIG. 5. This can allow dispenser 10 to be connected directly to a source of fluid (e.g., pressurized main water) without using a backflow protection device (e.g., vacuum breaker) on the fluid supply line. This can provide a universal dispenser system that can be installed in a variety of worldwide locations without necessitating more involved, site-specific modifications.

The number of overflow outlets 52 and the size and positioning of the outlets can vary, e.g., based on specific configuration of dispenser 10 and any local regulations concerning backflow protection features. In general, the total free area of overflow outlet 52 (or outlets, if multiple are used) may be sufficient to prevent fluid from backing up above the outlets (and into fluid supply inlet 22) under maximum fluid discharge conditions. In the configuration of FIG. 5, dispenser 10 has one overflow outlet 52 on one side of fluid distribution reservoir 18 and an identical overflow outlet on the opposite side of the reservoir (not shown in FIG. 5). Other configurations are possible, and it should be appreciated that the disclosure is not limited in this respect.

As noted above with respect to FIG. 2, dispenser 10 has at least one fluid supply inlet 22, which in FIG. 2 is illustrated as four fluid supply inlets. Each fluid supply inlet can be in selective fluid communication with inlet line 14 (FIG. 1) and configured to supply fluid to fluid distribution reservoir 18. While any desired number of fluid supply inlets 22 can be used in dispenser 10, configuring the dispenser with multiple fluid supply inlets can be useful to provide a more even distribution of fluid around solid product 24 than if a lesser number of fluid supply inlets are used. For example, if dispenser 10 is configured with only a single fluid supply inlet 22, solid product 24 may preferentially erode on the side of the dispenser on which the inlet directs incoming fluid. Overtime, this can cause solid product 24 to erode asymmetrically and tilt on platform 28, potentially impacting the consistency of the concentration of the solid product released during a dispense event. By utilizing multiple fluid supply inlets configured to dispense fluid at different positions around the perimeter of solid product 24, the solid product may erode more evenly.

Figure 6:
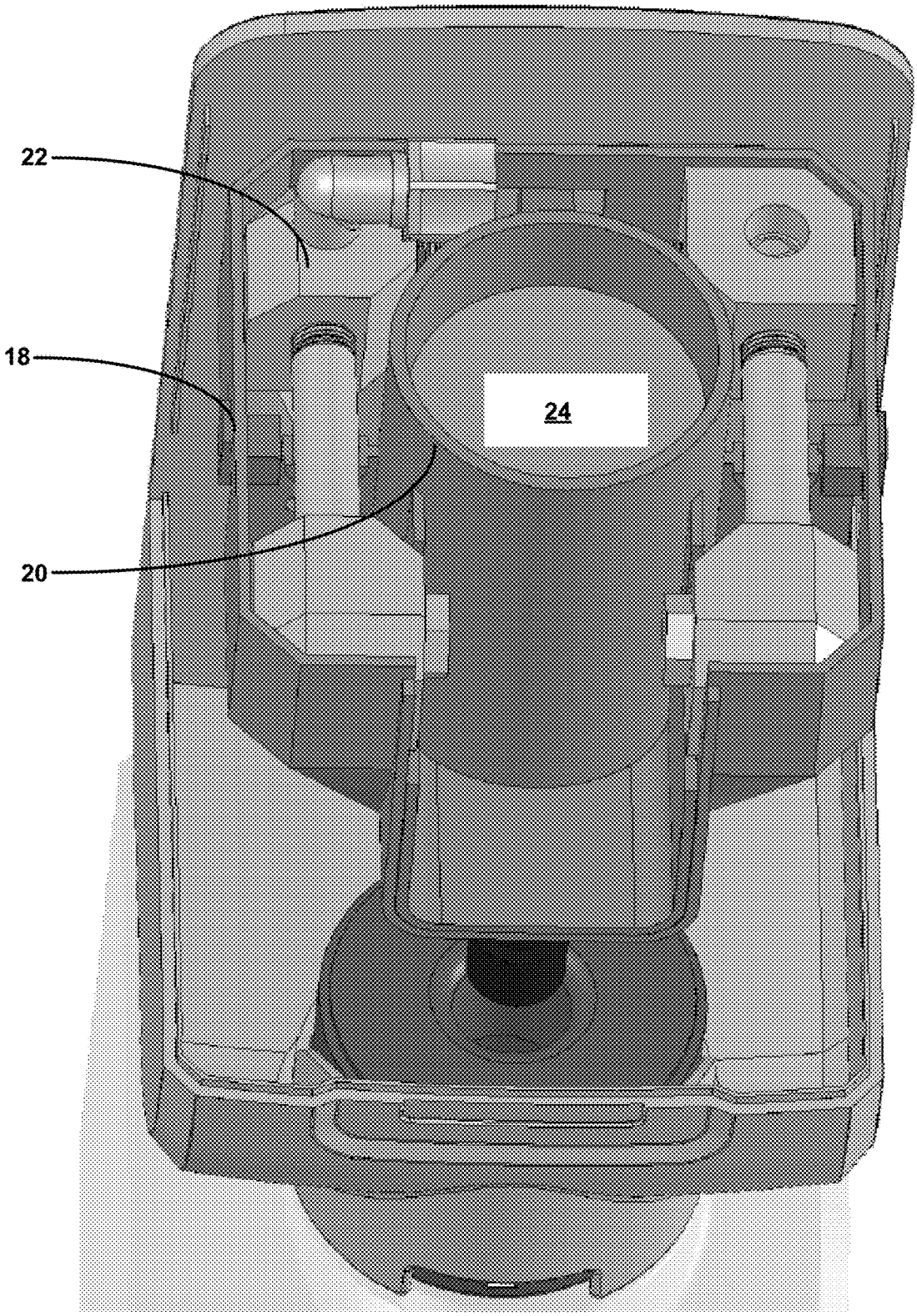
FIG. 6 is a top view illustration of the solid product dispenser of FIG. 1 showing an example number and arrangement of fluid supply inlets.

FIG. 6 is a top view of dispenser 10 showing an example number and arrangement of fluid supply inlets 22. In this example, four fluid supply inlets 22 are positioned about the perimeter of solid product 24, e.g., at 90 degrees with respect to each other. Each fluid supply inlet 22 is pointed downwardly into a cavity between fluid distribution reservoir 18 and product reservoir 20, although other configurations and orientations are possible. Fluid supply inlets 22 can be positioned substantially equidistant from each other about the perimeter of solid product reservoir 20 and solid product 24 to help provide uniform fluid dispensing during a dispense event. While FIG. 6 illustrates dispenser 10 as having four fluid supply inlets 22, the dispenser can have a greater (e.g., five, six, or more) or lesser (e.g., three, two, one) number of inlets.

In different examples, each fluid supply inlet 22 may or may not control the flow characteristics (e.g., pressure, velocity) of fluid discharged from the inlet. For example, fluid supply inlet 22 may be an orifice of a fluid supply line that discharges pressurized fluid supplied upstream of the inlet. In this configuration, fluid flow through fluid supply inlet 22 may be controlled by a valve but the fluid supply inlet itself does not impact the pressure or velocity of the fluid.

In another example, fluid supply inlet 22 comprises a pressure control device, such as a fluid restriction the changes the flow characteristics (e.g., the pressure and/or velocity) of fluid passing through the inlet. For example, fluid supply inlet 22 may be a jet or nozzle (e.g., a Venturi nozzle) having a region of reduced cross-sectional area that changes (e.g., increases or decreases) the pressure and/or velocity of fluid passing through the inlet as compared to immediately upstream of the inlet. In one configuration, each fluid supply inlet 22 has a pressure control device that is a pressure compensating flow regulator configured to provide a substantially constant flow rate of the pressurized fluid even if a pressure of the pressurized fluid varies. Such a pressure compensation device is commercially available from Neoperl®. A pressure compensating device can be useful to help provide a substantially constant volume of incoming fluid to dispenser 10 even if the pressure of a pressurized fluid source is changing.

With further reference to FIG. 2, dispenser 10 in the illustrated example includes a drip catch 26 positioned downstream of outlet 30 such that solution produced using dispenser 10 flows through the drip catch before being dispensed through dispensing outlet 16 (FIG. 1). Drip catch 26 can prevent drips that may otherwise occur at the end of a dispense event from dropping out through dispensing outlet 16, instead catching the drips to be conveyed out during a subsequent dispense event.

Figure 7:
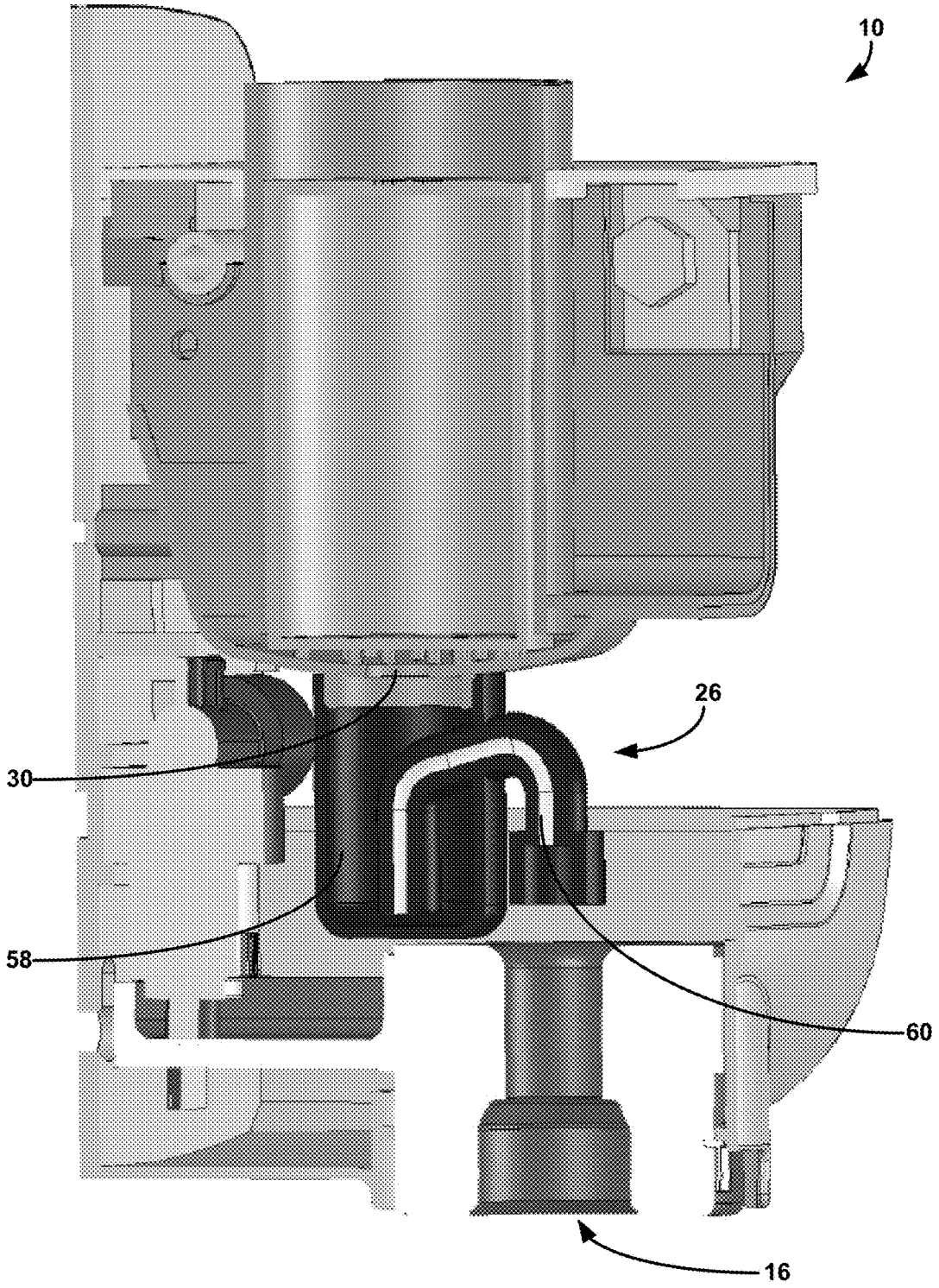
FIG. 7 is a cross-sectional illustration of the solid product dispenser of FIG. 1 showing an example drip catch configuration.

FIG. 7 is a cross-sectional illustration of dispenser 10 showing an example configuration of drip catch 26. Drip catch 26 is positioned below outlet 30. Drip catch 26 includes a comparatively small reservoir 58 and a siphon tube 60 in fluid communication with the small reservoir and dispensing outlet 16. Drip catch 26 can hold a small volume of chemical solution to prevent excess solution from undesirably dripping from the dispenser 10 after use. Chemical solution discharging through outlet 30 is retained in reservoir 58 before being siphoned out through siphon tube 60. At the end of a dispense event, any drips falling through outlet 30 can be retained in reservoir 58 without being siphoned out through tube 60. Such drips can collect in reservoir 58 until a subsequent dispense event, whereupon the accumulated drips will be discharged out of the reservoir with a flow of freshly generated chemical solution. While FIG. 7 illustrates one example configuration of a drip catch, other types of drip catch structures can be used without departing from the scope of the disclosure. For example, a plumbing p-trap may be used as an alternative design for drip catch 26. Other drip catch configurations are also possible.

Dispenser 10 according to the disclosure can be used in a variety of different applications to solubilize and dispense a variety of different solid products. In some applications, dispenser 10 is used as a single, standalone unit to dispense a single solid product. In other applications, multiple dispenser units 10 may be installed in a single location to provide redundant dispensers with the same solid product and/or different dispensers dispensing different solid products.

In applications where multiple units of dispenser 10 are intended to be used together (although not necessarily simultaneously) and geographically collocated, each dispenser may be configured with an interconnectable fluid distribution system. The interconnectable fluid distribution system can allow the dispenser units to be plumbed in series from a single common fluid source.

Figure 8:
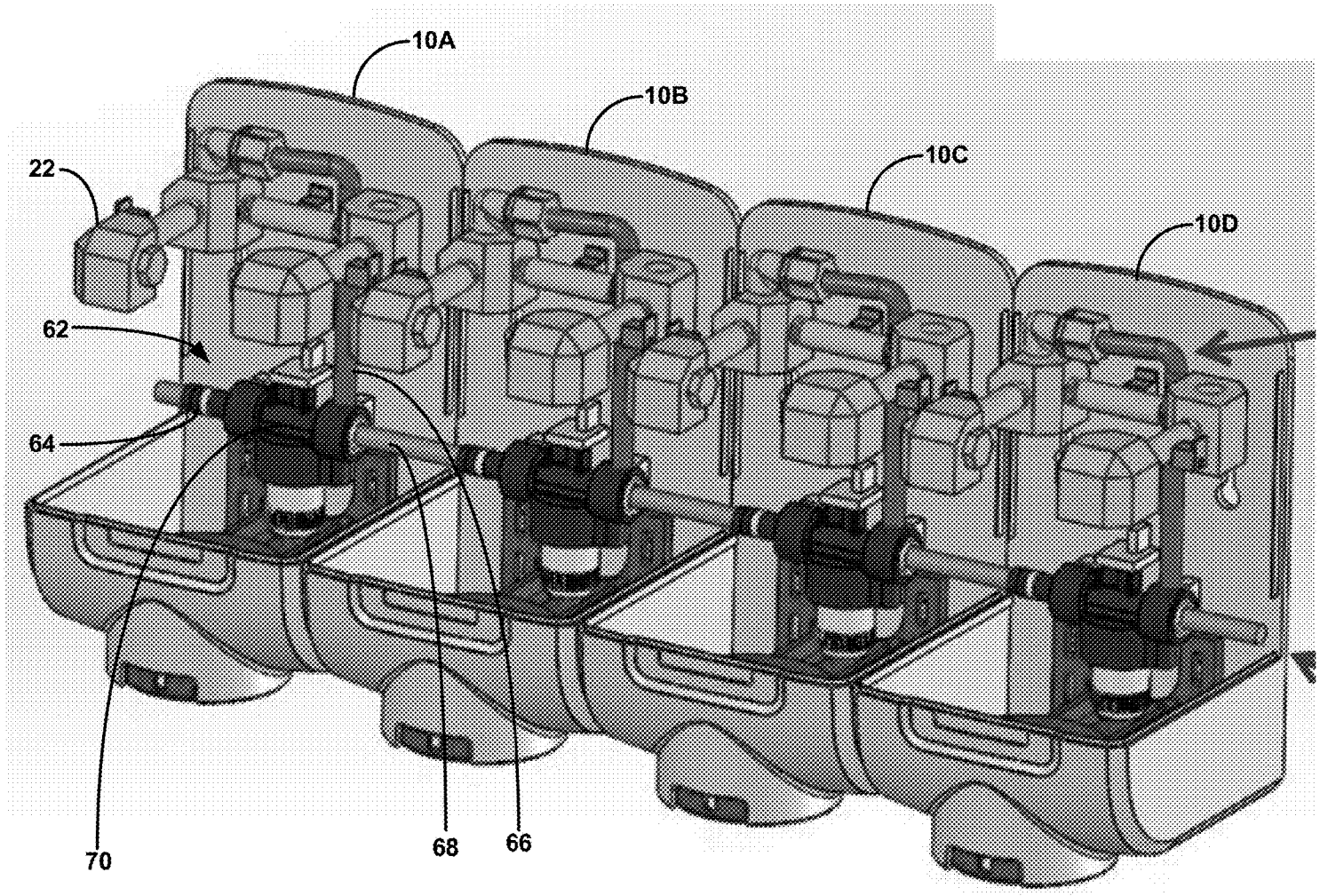
FIG. 8 is a perspective illustration of an example arrangement of multiple solid product dispensers.

FIG. 8 is a perspective illustration of an example arrangement of multiple solid product dispensers 10A-10D (collectively "dispensers 10"), each of which can have the design of dispenser 10 described with respect to FIGS. 1-7. Each dispenser 10 in FIG. 8 is shown without various components (e.g., housing 12, fluid distribution reservoir 18, product reservoir 20) for purposes of illustration. In the illustrated example, each dispenser 10 has a pressurized fluid supply manifold 62 that includes and inlet line 64, a supply line 66, and an outlet line 68. Inlet line 64 is configured to connect to a source of fluid (either directly or indirectly via one or more dispenser units 10). Supply line 66 is configured to convey fluid from inlet line 64 to fluid supply inlets 22. Outlet line 68 is configured to convey fluid from inlet line 64 to a downstream dispenser 10. In some examples, pressurized fluid supply manifold 62 also includes a valve 70 configured to control fluid communication inlet line 64 and supply line 66. For example, the position of valve 70 can dictate whether pressurized fluid is conveyed from inlet line 64 to supply line 66 or outlet 68, or both supply line 66 and outlet 68. Such an arrangement can facilitate modular implementation of dispenser 10, allowing multiple dispensers to be fluidly connected in series.

Various examples have been described. These and other examples are within the scope of the following claims.

The invention claimed is:

1. A product dispenser comprising:

a fluid distribution reservoir defining a perimeter and having an outlet configured to dispense a chemical solution formed in the fluid distribution reservoir;

a plurality of fluid supply inlets configured to supply a pressurized fluid to the fluid distribution reservoir;

a platform located in the fluid distribution reservoir, the platform being configured to hold a solid product and expose the solid product to the pressurized fluid, wherein the platform has a top surface that contacts the solid product, when the solid product is placed on the platform; and a solid product reservoir defining a solid product reservoir perimeter and being located in the fluid distribution reservoir, the solid product reservoir having a bottom edge and being configured to surround a portion of the solid product positioned on the platform and thereby shield the portion of the solid product from contact with the pressurized fluid;

wherein the top surface of the platform is vertically spaced from the bottom edge of the solid product reservoir such that the solid product is configured to protrude downwardly below the solid product reservoir, the perimeter of the fluid distribution reservoir surrounding the solid product reservoir perimeter with the plurality of fluid supply inlets being positioned at different positions around the solid product reservoir perimeter for dispensing pressurized fluid between the fluid distribution reservoir and the solid product reservoir, each of the plurality of fluid supply inlets being configured to supply pressurized fluid that flows past the solid product reservoir and contacts the platform, causing the pressurized fluid to redirect against the solid product and form the chemical solution via erosion of the solid product.

2. The dispenser of claim 1, further comprising at least one pressure control device configured to control flow characteristics of the pressurized fluid delivered through the plurality of fluid supply inlets.

3. The dispenser of claim 2, wherein the at least one pressure control device comprises a plurality of pressure control devices, each pressure control device being configured to control flow characteristics of pressurized fluid delivered through a respective one of the plurality of fluid supply inlets.

4. The dispenser of claim 2, wherein the pressure control device comprises a pressure compensating flow regulator that is configured to provide a substantially constant flow rate of the pressurized fluid even if a pressure of the pressurized fluid varies.

5. The dispenser of claim 1, further comprising a pressurized fluid supply manifold that includes an inlet line configured to connect to a source of fluid, a supply line configured to convey fluid from the inlet line to the plurality of fluid supply inlets, an outlet line configured to receive fluid from the inlet line and convey the fluid to one or more additional downstream dispensers, and a valve configured to control fluid communication between the inlet line and the supply line.

6. The dispenser of claim 1, wherein the fluid distribution reservoir comprises a basin that extends outwardly and vertically upwardly from the outlet.

7. The dispenser of claim 6, wherein the solid product reservoir comprises an annulus extending vertically downwardly toward the outlet and having an open end adjacent the platform.

8. The dispenser of claim 1, wherein a geometric center of the solid product reservoir is co-axial with a geometric center of the platform.

9. The dispenser of claim 1, wherein the fluid distribution reservoir further includes an overflow outlet positioned above the platform and below the fluid supply inlet.

10. The dispenser of claim 1, wherein the platform comprises a plurality of pegs having spaces between adjacent pegs such that the pressurized fluid flows through the spaces.

11. The dispenser of claim 1, wherein the platform is configured to redirect flow of pressurized fluid by providing flow path obstructions, the flow path obstructions creating turbulent flow of pressurized fluid that contacts solid product on the platform.

12. The dispenser of claim 1, wherein the outlet of the fluid distribution reservoir is positioned beneath the platform.

13. The dispenser of claim 1, further comprising a drip catch downstream of the outlet.

14. A dispenser comprising:

a water distribution reservoir having a base wall and at least one sidewall extending vertically upwardly from the base wall, the water distribution reservoir including an outlet extending through the base wall and configured to dispense a chemical solution formed in the water distribution reservoir;

a platform located inside of the water distribution reservoir and elevated above the base wall and outlet extending therethrough, the platform being configured to hold a solid block of concentrated chemical and allow fluid to flow between the solid block of concentrated chemical and the outlet;

a concentrated chemical reservoir located in the water distribution reservoir and at least partially enclosing the solid block of concentrated chemical in a region above the platform; and a plurality of water supply inlets positioned on different sides of the concentrated chemical reservoir and configured to direct pressured water between the at least one sidewall of the water distribution reservoir and the concentrated chemical reservoir, causing pressured water to contact the solid block of concentrated chemical adjacent the platform and form the chemical solution via erosion of the solid block of concentrated chemical.

15. The dispenser of claim 14, wherein the water distribution reservoir further includes an overflow outlet extending through the at least one sidewall at a location below the plurality of water supply inlets.

16. The dispenser of claim 14, wherein the platform has a top surface that contacts the solid block of concentrated chemical, when the solid block of concentrated chemical is placed on the platform, the concentrated chemical reservoir has a bottom edge, and the top surface of the platform is vertically spaced from the bottom edge of the concentrated chemical reservoir such that the solid block of concentrated chemical is configured to protrude downwardly below the concentrated chemical reservoir.

17. The dispenser of claim 14, further comprising a plurality of pressure control devices, each pressure control device being configured to control flow characteristics of pressurized water delivered through a respective one of the plurality of water supply inlets.

18. The dispenser of claim 14, further comprising a pressurized water supply manifold that includes an inlet line configured to connect to a source of water, a supply line configured to convey water from the inlet line to the plurality of water supply inlets, an outlet line configured to receive water from the inlet line and convey the water to one or more additional downstream dispensers, and a valve configured to control fluid communication between the inlet line and the supply line.

19. A method comprising:

discharging pressurized fluid through a plurality of inlets located at different positions around a solid product reservoir surrounded by a fluid distribution reservoir, the pressurized fluid being discharged between a sidewall of the fluid distribution reservoir and a sidewall of the solid product reservoir, the solid product reservoir containing a solid product positioned on a platform raised above a base wall of the fluid distribution reservoir, the plurality of inlets being positioned substantially equidistant from each other around the solid product reservoir;

directing the pressurized fluid toward the platform, thereby causing the pressurized fluid to change from a generally vertical flow direction with respect to gravity to a generally horizontal flow direction and contact the platform, providing a turbulent flow of pressurized fluid that erodes the solid product positioned on the platform; and discharging a chemical solution formed from erosion of the solid product through an outlet formed through the base wall of the fluid distribution reservoir.

20. The method of claim 19, wherein directing the pressurized fluid toward the platform comprises partially filling the fluid distribution reservoir with fluid such that the solid product positioned on the platform is contacted with accumulated fluid.

21. The method of claim 19, wherein the fluid comprises water and the solid product comprises at least one of a concentrated cleaning composition, a concentrated sanitizing composition, a concentrated pesticide composition, and a concentrated water treatment additive.

22. The method of claim 19, wherein the solid product is a block of material.

23. The method of claim 19, further comprising conveying pressurized fluid through a dispenser containing the fluid distribution reservoir and the solid producer reservoir to a downstream dispenser.

* * * * *